US005635027A

United States Patent [19]

Spontak et al.

[11] Patent Number: 5,635,027

[45] Date of Patent: Jun. 3, 1997

[54] METHOD OF REDUCING THE VISCOSITY OF A BLACK LIQUOR

[75] Inventors: Richard J. Spontak, Raleigh; Joanna E. Roberts, Charlotte, both of N.C.; Victoria A. Prevysh, San Francisco, Calif.; Saad A. Khan, Raleigh, N.C.

[73] Assignee: North Carolina State University, Raleigh, N.C.

[21] Appl. No.: 415,930

[22] Filed: Apr. 3, 1995

[51] Int. Cl.[6] ..... D21C 11/12

[52] U.S. Cl. ..... 162/30.11; 162/32; 162/36; 162/39; 162/42; 162/82; 162/90

[58] Field of Search ..... 162/16, 17, 19, 162/24, 29, 30.11, 32, 36, 35, 38, 39, 42, 90; 203/30

[56] References Cited

U.S. PATENT DOCUMENTS

| | | | |
|---|---|---|---|
| 3,516,910 | 6/1970 | Engman et al. | 203/7 |
| 4,255,309 | 3/1981 | Klaessig et al. | 260/29.6 |
| 4,331,507 | 5/1982 | Roberts | 162/29 |
| 4,367,191 | 1/1983 | Cuculo et al. | 264/187 |
| 4,498,955 | 2/1985 | Nelson | 162/30.11 |
| 4,514,256 | 4/1985 | Kober et al. | 162/30.11 |
| 4,734,103 | 3/1988 | Fong et al. | 44/51 |
| 4,911,787 | 3/1990 | Shimokura et al. | 162/30.11 |
| 5,213,662 | 5/1993 | Henricson | 162/19 |
| 5,326,479 | 7/1994 | Sarkar et al. | 210/719 |
| 5,472,568 | 12/1995 | Mullen et al. | 162/30.11 |

*Primary Examiner*—Christopher Kim

*Attorney, Agent, or Firm*—Bell, Seltzer, Park & Gibson

[57] ABSTRACT

A method of recycling sodium-based salts used for digesting wood in a digester during the manufacture of pulp and paper. The method comprises collecting a black liquor from the digester, concentrating the black liquor, and adding a salt to the black liquor in an amount sufficient to reduce the viscosity thereof. Preferred salts are thiocyanate salts. The black liquor is then oxidized to produce a green liquor and a causticizer added to the green liquor to produce a white liquor containing the sodium-based salts to be recycled. The white liquor is then returned to the digester.

6 Claims, 8 Drawing Sheets

METHOD OF REDUCING THE VISCOSITY OF A BLACK LIQUOR

FIELD OF THE INVENTION

The present invention relates to a method of reducing the viscosity of an alkaline liquor, particularly black liquor formed during pulp and paper manufacture.

BACKGROUND OF THE INVENTION

The most common process used for the production of pulp and paper is known as the Kraft process. J. Gierer, *Wood Sci. Technol.* 14, 241–266 (1980). In this operation, wood chips and various chemicals known as white liquor are cooked in a digester to produce pulp and a residual black liquor.

The black liquor contains wood components, including lignin, dissolved during digestion and also contains inorganic materials such as sodium sulfate and sodium carbonate. The black liquor leaving the digester has a concentration of about 15 percent total solids. In order to burn efficiently in a recovery boiler, the liquor must be concentrated, usually in multiple-effect evaporators, to about 65 percent total solids. The liquor is then burned in the recovery boiler where further concentration of the liquor and combustion of the liquor solids occur. The inorganic components are recovered from the liquor in the boiler, redissolved in water, and then causticized to regenerate the white liquor used to digest the wood chips in the first step of the process.

In order for this process to be cost effective, however, the cooking chemicals which react and become a part of the black liquor must be efficiently recovered. J. Smook, *Handbook for Pulp and Paper Technologists,* 2nd ed., 1992, Chapt. 7 and 10. As mentioned previously, in order to regenerate these chemicals, the black liquor is subjected to several treatments that include evaporation and burning. These two steps play a crucial role due to their large energy consumption. Because the costs of energy have greatly increased in recent years, the pulp and paper industry has begun processing black liquor with higher solids concentrations in the recovery boiler. L. Soderhjelm, *Paperi ja Puu* 9, 642–652 (1986). Higher solids enhance recovery boiler performance by providing increased boiler capacity, lower emissions, and higher thermal efficiency. M. Boone, 1991 *Tappi Kraft Recovery Operations Short Course,* 93–97 (1991). The ability to concentrate black liquor is limited, however, by its rheological (deformation and flow) properties. Black liquor shows an exponential increase in viscosity as its solids content rises P. Ramamurthy, A. Mujumdar, A. van Heiningen, G. Kubes, *Tappi,* 195–202 (April 1992)), thereby preventing its processability in terms of transport, storage, and handling. As a result, black liquor having a solids content greater than about 70 percent has too high a viscosity to pump or otherwise process.

Black liquor is a complex aqueous system made up of several components including, polysaccharides, lignin, salts, and fatty acids. Previous research has reported conflicting results as to which of these components may be responsible for the elevated viscosity. Both the lignin (J. Small, A. Fricke, *Ind. Eng. Chem. Prod. Res. Dev.* 24, 608–614 (1985)) and the polysaccharide (L. Soderhjelm, 1989 *Int'l. Chem. Recovery Conf. Proc.,* 95–99 (1989)) fractions may be the cause. Nonetheless, strong (or concentrated) black liquor becomes a sticky, unpumpable liquid with increasing solids content. M. Boone, 1991; P. Ramamurthy et al., April 1992. Even with less concentrated, more pumpable liquor, pluggage and scaling in the recovery boiler are a critical issue. R. Ryham, S. Nikkanen, 1992 *Kraft Recovery Operations Short Course,* 222–238 (1992).

In order to prevent the problems described above, methods such as heat treatment (L. Soderhjelm, 1986; R. Ryham, 1992 *Int'l. Chem. Recov. Conf.,* 581–588 (1992); L. Soderhjelm, *Appita* 41, No. 5, 299–392 (1988)) and oxidation (E. Milanova, G. Dorris, *Jour. of Pulp and Paper Science* 16, No. 3, J94–J101, (1990); W. Frederick, T. Adams, 1992 *Kraft Recovery Operations Short Course,* 97–112 (1992)) are being used to reduce the viscosity of black liquor and obtain a higher solids content. In the heat treatment process, the liquor is removed from the evaporators and heated at an elevated temperature for an extended period of time (i.e. about 140° C. for 2 hours) (L. Soderhjelm, 1988). This procedure results in an irreversible decrease in viscosity due to a depolymerization of the large polymer chains present within black liquor. R. Ryham et al., 1992. In the oxidation process, the liquor is exposed to air in order to convert the sulfide in black liquor to thiosulfate. E. Milanova et al., 1990. This oxidation reaction provides a reduction in viscosity by lowering the residual alkali concentration. This reduction is, however, reversible, and addition of alkali following the oxidation will return the liquor to its original viscosity.

Both heat treatment and oxidation have significant disadvantages. They may cause an increase in viscosity if the black liquor has an initially low residual alkali. W. Frederick et al., 1992. Both processes are also cost intensive and may not be worth the advantage that they provide. For example, heat treatment requires energy to raise the temperature of the liquor. Similarly, oxidation rids the liquor of its fuel value which requires more energy input. J. Smook, 1992. A more advantageous procedure for reducing the viscosity of black liquor to obtain a processable, high solids liquid is needed.

In addition to heat treatment and oxidation, other methods exist for lowering the viscosity of alkaline waste liquor, including black liquor. U.S. Pat. No. 4,911,787 discloses a method and an apparatus for concentrating black liquor wherein $CO_2$ gas is added to the black liquor to reduce its boiling point and its viscosity. The disadvantages of this method include the requirement of additional equipment needed to dissolve the $CO_2$ in the liquor. Because the addition of $CO_2$ to black liquor results in the generation of $H_2S$, an additional oxidation step such as adsorption, membrane separation, or low temperature processing may be required. Furthermore, the absorption of $CO_2$ in quantities necessary for viscosity reduction is adversely limited by the temperature and pH of the liquor.

U.S. Pat. No. 4,734,103 discloses a high solids black liquor having the property of reduced turbulent flow/drag comprising a high solids black liquor which contains a few parts per million of a water soluble terpolymer such as acrylic acid-acyrylamide-sulfo lower alkyl acrylamide polymer. Additional equipment is needed to produce the polymers which are added to the black liquor.

The present invention results in a high solids content black liquor of much lower viscosity than enabled by the methods disclosed above.

SUMMARY OF THE INVENTION

The present invention provides a novel method for reducing the viscosity of a alkaline waste liquor produced during pulp and paper manufacture by adding certain salts, preferably a thiocyanate salt, to said black liquor in an amount sufficient to reduce its viscosity, thereby reducing the costs associated within reclaiming the chemicals from the black liquor. The invention also provides useful intermediate liquor solutions, containing certain salts (preferably a thiocyanate salt), of relatively high solids content (greater than 65 weight percent) and yet having relatively low viscosity which can be more efficiently recycled into reusable white liquor for digesting wood chips during the process of making pulp and paper. This invention involves the addition of certain salts to black liquor or other alkaline liquors used in the pulp and paper industry.

In view of the foregoing, a first aspect of the present invention is a method for reducing the viscosity of a alkaline waste liquor produced during pulp and paper manufacture. The method comprises adding a salt to the black liquor in an amount sufficient to reduce the viscosity thereof. Preferably the salt is a thiocyanate, perchlorate, iodide, nitrate, or bromide salts.

A second aspect of the present invention is an alkaline waste liquor, particularly a black liquor, produced during the process of manufacturing pulp and paper. The liquor has a pH of at least 11 and a solids content of from about 15 to about 90 percent. The liquor further comprising between about 0.01 and 5 moles of a salt (as given above) per liter of liquor solution.

The foregoing and other objects and aspects of the present invention are set forth in the drawings herein and the specification below.

BRIEF DESCRIPTION OF THE DRAWINGS

FIG. 5 shows the effect of the type of wood on the degree of salting-in.

DETAILED DESCRIPTION OF THE INVENTION

Figure 1:
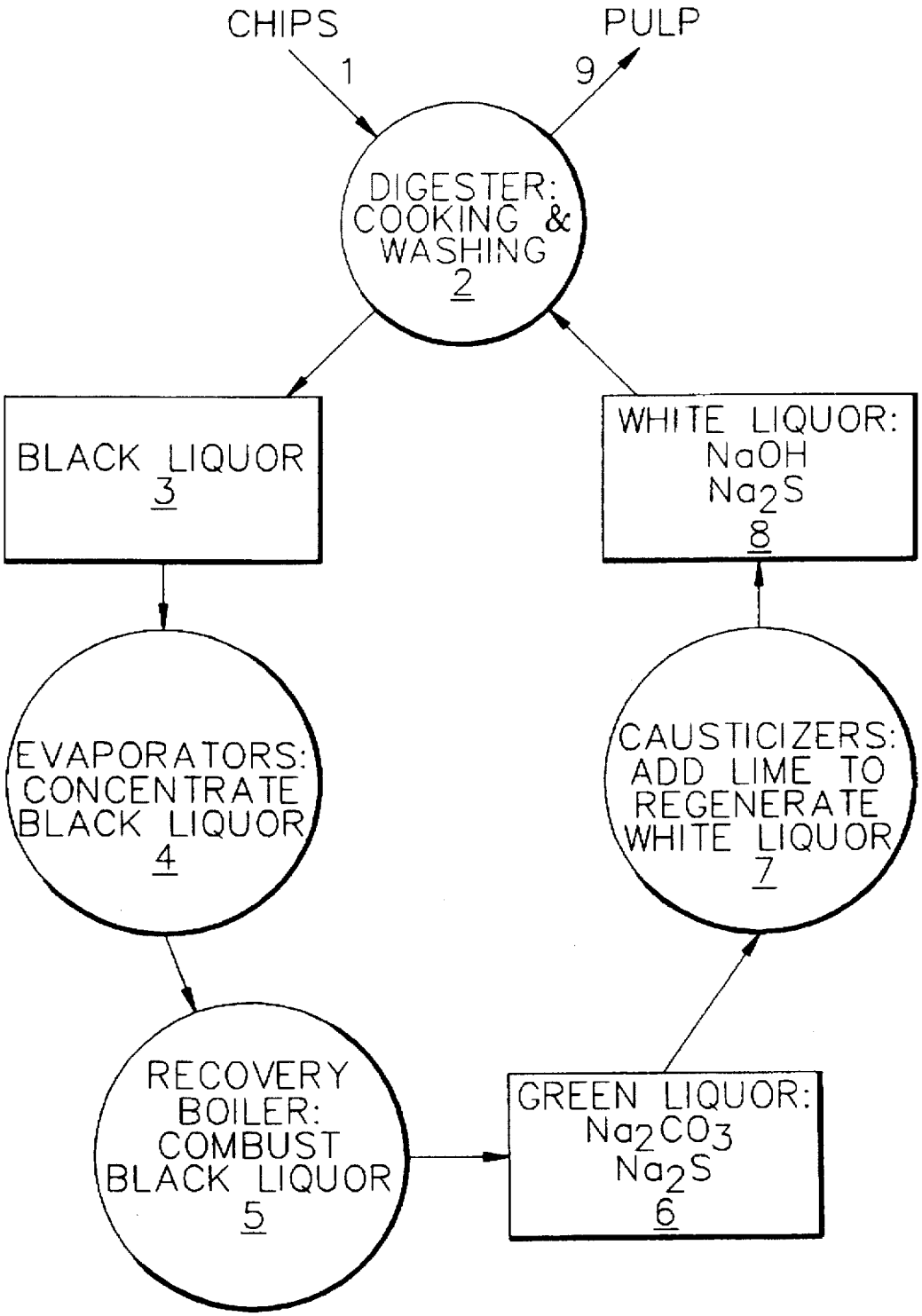
FIG. 1 depicts the chemical recovery cycle of the Kraft process.

As shown in FIG. 1, in the preparation of pulp by the Kraft process, wood chips 1 are added a digester 2 which is also fed a white liquor solution 8 of NaOH (sodium hydroxide) and $Na_2S$ (sodium sulfide) to form pulp 9. During this process the white liquor 8 becomes black liquor 3 as organic compounds, such as lignin, polysaccharides, and aliphatic acids, from the wood chips dissolve in the white liquor. The black liquor 3, including water from the washing operation 2 and having a solids content of about 15 percent by weight, is fed to a multiple-effect evaporator train 4 where the black liquor is concentrated to a solids content of about 65 percent before being fed to a recovery boiler 5 where it is burned. In the recovery boiler 5, the water remaining in the black liquor is evaporated and the organic compounds are oxidized. The inorganic, sodium based compounds are recovered from the boiler 5 and redissolved in water to form a green liquor 6 containing $Na_2CO_3$ (sodium carbonate) and $Na_2S$. The green liquor 6 is fed to a causticizer 7 where a causticizer such as lime is added to regenerate white liquor 8 containing NaOH and $Na_2S$ for reuse in the digester 2. Thus, the present invention comprises: (a) collecting a black liquor from the digester; (b) concentrating the black liquor; and (c) adding a salt to the black liquor (either before or after the concentrating step) in an amount sufficient to reduce the viscosity thereof; (d) oxidizing the black liquor to produce a green liquor; then (e) adding a causticizer such as lime to the green liquor to produce white liquor containing the sodium-based salts; and then (f) returning the white liquor to the digester.

In general, the black liquor will have a pH of at least 11, 12, or 13 to 14, 15, or 16 or more. The solids concentration of the black liquor will, as noted above, be at least 15 to 90 percent solids by weight. With respect to concentrated black liquors the solids concentration will typically be at least 55, 60 or 65 percent up to about 90 percent solids by weight.

A variety of salts can be used in carrying out the present invention, including (with respect to the anion) thiocyanate, perchlorate, iodide, nitrate, and bromide salts. The cation of the salt is not particularly critical, with exemplary cations including ammonium, sodium, potassium, lithium, and guanidine. Thus, specific examples of salts that may be used to carry out the present invention include: ammonium thiocyanate, ammonium perchlorate, ammonium iodide, ammonium nitrate, ammonium bromide, sodium thiocyanate, sodium perchlorate, sodium iodide, sodium nitrate, sodium bromide, potassium thiocyanate, potassium perchlorate, potassium iodide, potassium nitrate, potassium bromide, lithium thiocyanate, lithium perchlorate, lithium iodide, lithium nitrate, lithium bromide, guanidine thiocyanate, guanidine perchlorate, guanidine iodide, guanidine nitrate, and guanidine bromide. Thiocyanate, perchlorate, and iodide salts are preferred, and thiocyanate salts (particularly guanidine thiocyanate and ammonium thiocyanate) are most preferred.

The salt may be added before the black liquor is concentrated, between any of the evaporator effects or after the evaporator effects. It is preferably added in dry crystalline form (though it may also be added in aqueous form), and is preferably added after the evaporator effects when the temperature of the black liquor is higher in order to aid in dissolving the crystals in the liquor. While the precise concentration of salt added is not critical so long as the desired effect is obtained, and may be determined by routine procedures, between about 0.01, 0.1 or 0.5 moles to 1, 2, 3, 4 or 5 moles of salt per liter of concentrated liquor solution is typically employed. The addition of more than about 1 mole of salt per liter of concentrated liquor solution is less cost effective and may not result in further significant viscosity reduction. The addition of more than about 4 or 5 moles of salt per liter of concentrated liquor may in some cases supersaturate the liquor with the salt and ultimately increase its viscosity.

As noted above, another aspect of the invention is an alkaline waste liquor, such as black liquor, produced by the Kraft process during pulp and paper manufacture having a pH of at least 11, a solids content of from 15 to 90 percent, and containing between about 0.01 and about 5 moles of a salt, preferably a thiocyanate salt, per liter of liquor.

While not wishing to be bound to any particular theory of the invention, it is currently understood that thiocyanate and other salts listed above reduce the viscosity of any aqueous waste liquor from a pulp and paper making process based on the principles discussed below.

In aqueous systems such as alkaline liquor, including black liquor, there are several complicated interactions between the water, polymers, and salts in solution arise and play a crucial role in the development of process-controlling theological properties. The solubility of the solutes, which is related to the viscosity, will depend on solute-water interactions, ionic interactions with the salts in solution, and repulsive electrostatic forces when the solute molecules are charged. Scopes, 1987.

From a thermodynamic standpoint, changes in the aqueous system can be understood in terms of the Gibbs-Duhem equation. For a three component system (macromolecule, water, and salt), the equation is as follows:

$$N_m du_m + N_w du_w + N_s u_s = 0$$

where N is the number of moles of each component and u is the component's chemical potential. P. von Hippel, T. Schleich, *Structure and Stability of Biological Macromolecules,* Marcel Dekker, New York, 1969, Chapt. 6 (1). It is apparent that a change in one component will cause a change in one or both of the two remaining components. Therefore, altering the concentration of salt will change the chemical potential of the macromolecule in solution. P. von Hippel et al., 1969.

The addition of neutral salts to an aqueous system can affect macromolecular chemical potential through both lyotropic (change in $u_w$) and electrostatic interactions (change in $u_m$). von Hippel et al., 1969. The concentration range in which a salt exhibits salting in or out depends on the balance between these two phenomena. In general, salts show a salting in regime at low salt concentrations and then exhibit salting out as the concentration is increased. W. Melander, C. Horvath, *Arch. Biochem. Biophys.* 183, 200–215 (1977).

Lyotropic interactions affect macromolecular solubility indirectly, through induced changes in water structure. von Hippel et al., 1969. Thus, to better understand this process, it is necessary to understand the molecular structure of water. Water, like ice, has a tetrahedral arrangement of hydrogen bonded molecules. I. Mikhailov, Y. Symikov, *Jour. of Structural Chem.* 1, 10–24 (1960). Water has, however, a less compact structure with open spaces in the lattice. I. Mikhailov et al., 1960. Water molecules are free to diffuse and fill unoccupied spaces that evolve because the structure of water constantly changes due to the nature of its hydrogen bonds. These hydrogen bonds are cooperative H. Frank, W-Y Wen, *Disc. Faraday Soc.* 24, 133–140 (1957) so that when one hydrogen bond forms, several tend to form. Similarly, when one breaks, several others break. Such molecular cooperation occurs because a hydrogen bond is in fact an acid-base interaction; that is, one molecule in the bond becomes more acidic and the other becomes more basic. H. Frank et al., 1957. The strength of the acid-base interaction is increased if the participating molecules can bond with additional neighboring water molecules. H. Frank et al., 1957. These cooperative groups of hydrogen bonds are sometimes referred to as "flickering clusters" (H. Frank et al., 1957) because they continually form and break apart within water. When a non-polar solute dissolves in water, a more crystalline structure called an "iceberg" is formed a the cluster. H. Frank, M. Evans, *Jour. of Chemical Physics* 13, No. 11, 507–532 (1945). This effect is also observed with solutes containing some hydrophobic regions. Melander et al, 1977. Water molecules surround the non-polar region and result in an effective reduction in entropy. H. Frank et al., 1945.

Addition of ions in the form of salts to an aqueous solution tends to change the number of free water molecules available to hydrate a macromolecule. The salt-induced change in water structure becomes particularly important above a concentration of 0.2M because one or more solute molecules are present within each cluster of water molecules. Luck, 1980. At this concentration, the solubility of a dissolved polymer is affected, resulting in a substantial change in solution viscosity.

The most common effect of salt addition is known as "salting-out." This phenomenon occurs because the salt ions create ionic fields that are able to polarize the surrounding molecules. Polarized molecules are then attracted toward the ions and push away the less polarizable molecules. B. Conway, *Elsevier Scientific Pub. Co.,* Canada 1981, Chapt. 20. If water is the solvent, it is readily polarized in the presence of many salt ions and physically separates non-electrolyte components of the solution away from the ions. B. Conway, 1981. In aqueous polymer solutions, more salt-induced water-water hydrogen bonds form whereas the water-polymer interaction needed for solubility break. The salt acts as a "structure maker" (W. Luck, (Stanley P. Rowland, ed.), *Amer. Chemical Society,* Washington, D.C. 1980, Chapt. 3) by allowing more iceberg structures to form. The solubility of the macromolecule decreases and can eventually lead to precipitation of the solute. Scopes, 1977.

Some large and weakly polarizing ions have, however, the opposite effect. W. Luck, 1980; D. Balzer, *Langmuir* 9, 3375–3384 (1993). These ions are referred to as "structure breakers" (W. Luck, 1980) because they hinder the formation of water clusters. This phenomenon is known as "salting-in." The break up of water-water hydrogen bonds frees up water molecules to form more water-polymer interactions, thus increasing the solubility of the polymer in solution.

The order in which ions are able to change water structure is analogous to the Hofmeister or lyotropic ion series. W. Luck, 1980. This series is related to the size and hydration of ions. J. Edsall, J. Wyman, *Biophysical Chemistry,* vol. 1, Academic Press, New York, 1958, Chapt. 5. Anions dominate the salting in/out effect, and therefore, it is their position in the series that is most important. I. Robb, *Chemistry and Technology of Water-Soluble Polymers* (C. A. Finch ed.) Plenum Press, New York 1983, 192–202. The position of the cation does, however, play a role in a salt's lyotropic effect. The roles of the anion and cation are additive and coupling a structure a structure breaking cation with a structure breaking anion will increase the destabilizing effect of the anion. P. von Hippel, T. Schleich, *Acc. Chem. Res.* 2, 257–265 (1969).

The lyotropic salt effect can be explained further with the definition of the Setschenov coefficient, $k_s$:

$$k_s = \ln y = \ln (S_o/S)$$

where $S_o$ is the solubility of the macromolecule with no salt present, S is its solubility in the presence of salt at concentration C, and y (gamma) is the activity of the macromolecule (Conway, 1981). From this relationship, salting out is given by positive values of $K_s$ and ln y. Thus, the activity of the macromolecule is increased by the addition of the salt. (This occurs indirectly through the decrease in activity of the water.) On the other hand, salting in is associated with negative values of $k_s$ and ln y, showing a reduction in the macromolecule's activity upon salt addition. Conway, 1981.

When the polymer in solution is charged, as in the case of kraft lignin, adding a salt may affect the solubility of the polyelectrolyte lyotropically as well as by changing the electrostatic interactions in the solution. Unlike lyotropic effects, electrostatic effects depend on the sign and magnitude of the ion's charge rather than the ion structure. von Hippel et al., 1969. At low salt concentration (but usually below 1M) the solubility of a charged macromolecule increases due to Debye-Huckel electrostatic effects. Melander et al., 1977; M. Mandel, *Chemistry and Technology of Water Soluble Polymers*, Plenum Press, New York, 1983, Chapt. 10. For example, if the molecule is a polyanion, the cations from the added salt will cluster around the negative charges on the polymer. This effective "charge neutralization" decreases the intermolecular repulsive forces and increase the polyelectrolyte solubility. Voet et al., 1990. When enough salt has been added to "neutralize" all of the charges on the polyelectrolyte it acts as a non-charged solute and lyotropic salt effects begin to dominate. Melander et al., 1977. However, at very high ionic strengths (if salting out has not already occurred due to lyotropic effects), the salt ions require such a large portion of water for solvation there is not enough water available to solvate the macromolecule in solution. D. Voet, J. Voet, *Biochemistry*, John Wiley and Sons, New York, 1990, Chapt. 5. Thus, the solubility of the polyelectrolyte is decreased and salting out is observed.

The effects described above refer to addition of neutral salts to an aqueous solution. An acidic or basic salt could affect the pH of the solution (Scopes, 1987), thus changing the critical interactions between the water and solutes (yon Hippel et al., 1969). This is especially important with kraft lignin which begins to associate and precipitate from solution as the pH drops. T. Lindstrom, *Colloid and Polymer Sci.* 257, 277–285 (1979).

In order to optimize the viscosity reduction, the proper cation must be paired with the anion. In the case of black liquor (which contains negatively charged Kraft lignin molecules), the cation has the potential to affect the macromolecular solubility both electrostatically and lyotropically. Tests described below were conducted with five cations, $Gu^+$ (guanidine), $NH_4^+$ (ammonium), $Na^+$ (sodium), $K^+$ (potassium), and $Li^+$ (lithium) paired with the thiocyanate ($SCN^-$) anion. Guanidine is the preferred cation to pair with the thiocyanate ion. Lithium will cause problems similar to iodine and ammonium does not act as a neutral salt at high pH. These cations may be paired with the other anions, perchlorate, iodide, nitrate, and bromide, to form other salts for use according to the present invention.

The present invention is explained in greater detail in the following non-limiting examples, in which volumes are in milliliters (ml), concentrations are in moles of salt per liter of concentrated black liquor solution (M), viscosity is in poise, percent total solids is in weight percent of solution, and temperatures are given in degrees Centigrade (° C.)unless otherwise indicated.

EXAMPLES

Commercial black liquors obtained from Weyerhauser Company (New Bern, N.C.) were used. With the exception of the softwood sample, tests were conducted using 80 percent softwood/20 percent hardwood samples that had been obtained from the pulp mill at a solids concentration of 62 percent. The softwood sample had an initial solids concentration of 61 percent. Samples of different solids concentration were obtained by heating approximately 250 ml of the pulp mill liquor for different time periods in an open container. Samples were continuously stirred at temperatures not exceeding 90° C. A small, pre-weighed portion of each sample was then dried in an oven at 100° C. for 48 hours, and weighed again to determine its solid content. Since black liquor viscosity may vary between batches even at the same concentration (L. Soderhjelm, 1986), samples at different concentrations were prepared from the same master batch to eliminate such errors.

Samples containing thiocyanate salts were prepared by adding appropriate amounts on a molar (M) basis of salt crystals to already concentrated liquor samples (i.e., moles of thiocyanate salt per liter of concentrated liquor solution). The mixtures were then stirred vigorously and heated at about 40° C. for 30 minutes to dissolve the salt. Each sample was covered to avoid evaporation of water. Control samples were treated the same way to ensure similar thermal history for all materials. In order to determine if the salt adding sequence had any effect on black liquor properties, samples were also prepared by adding $NH_4SCN$ salt to the pulp mill liquor and subsequently concentrating the solution following the procedure outlined in the previous paragraph.

A Rheometrics Dynamic Stress Rheometer (DSR II) with 25 mm plate geometry was used to measure the rheological properties of black liquor. All experiments were conducted at 25° C. with specially coated tools capable of withstanding the elevated pH of black liquor (≈12–14). Solids concentrations discussed below were determined prior to adding any salt.

EXAMPLE 1

Figure 2:
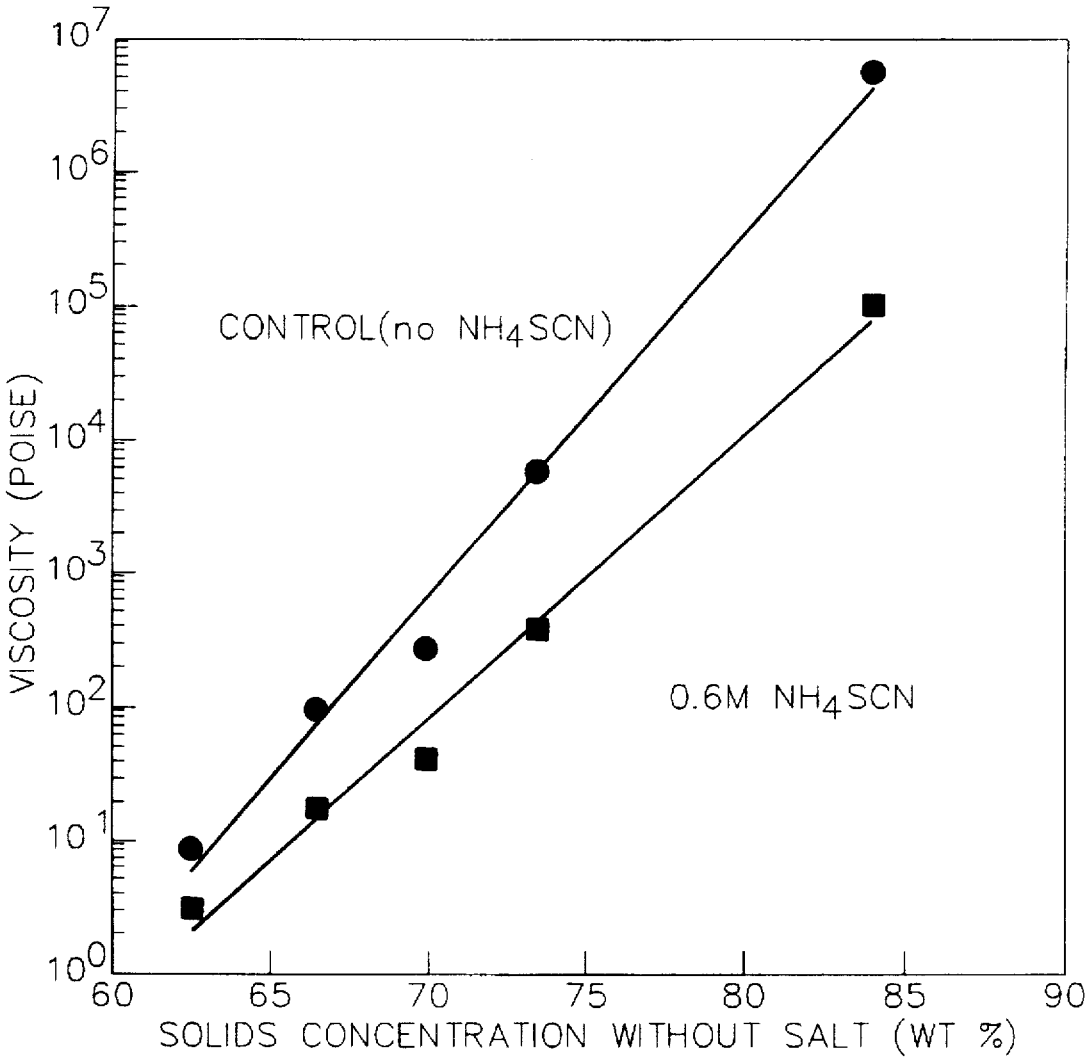
FIG. 2 shows a comparison of the viscosity change with increasing solids content of a control black liquor and a black liquor containing 0.6M $NH_4SCN$ (ammonium thiocyanate).

FIG. 2 illustrates the effect ammonium thiocyanate salts on the viscosity of a commercial black liquor. Solids concentration is plotted along the x-axis, and viscosity is shown on the y-axis. The added salt significantly retards the increase of black liquor viscosity, especially at high solids content (shown by the line through the solid rectangular data points), compared to the viscosity of the sample without salt (shown by the line through the solid circular data points). This enables evaporation of salt-containing liquor to a higher solids content without causing any of the processing problems discussed earlier.

Tests were run where the salt as added prior to concentrating the liquor and after concentrating the liquor. Salting-in theory suggests and this test confirms that the interactions between the water, salt, and other components in the solution should not change as long as the relative proportions of the mixture remain the same. The same results were obtained when the salt was added prior to concentrating the liquor as for the sample where the salt was added after concentrating the liquor.

While the data shown in FIG. 2 shows that ammonium thiocyanate additions are capable of producing a viscosity reduction in black liquor, the effect of salting-in is very dependent upon the concentration of salt added.

EXAMPLE 2

Figure 3:
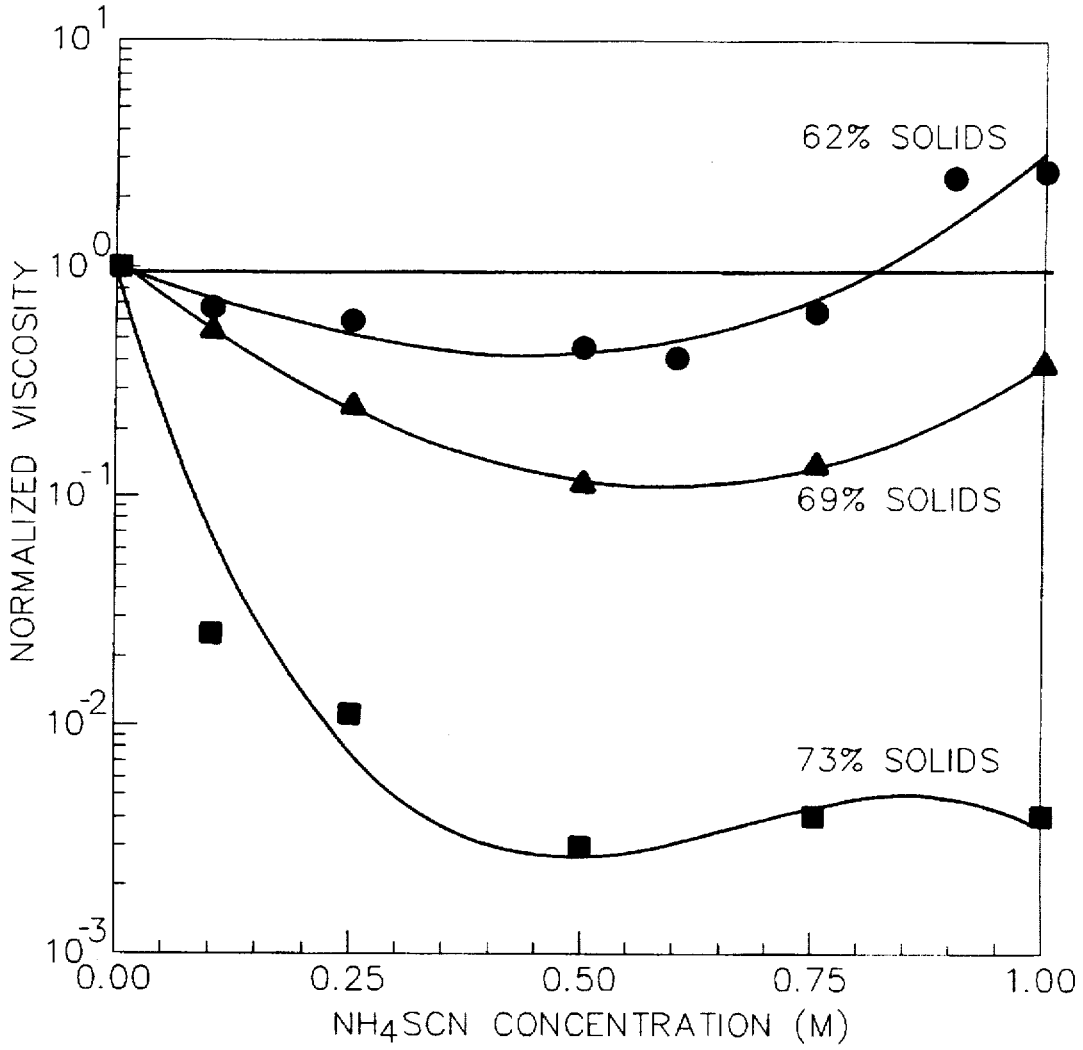
FIG. 3 shows the effect of $NH_4SCN$ concentration on viscosity of three black liquor samples.

FIG. 3 shows the effects of adding different amounts of a thiocyanate salt, in this case ammonium thiocyanate, to black liquors of three different solids concentrations. The ammonium thiocyanate concentration from 0.00 to 1.00M is plotted on the x-axis, and normalized viscosity from $10^{-3}$ to $10^1$ of the black liquor solutions is plotted on the y-axis. Normalized viscosity was determined by dividing the actual viscosity of the particular concentrated liquor sample containing the salt by the actual viscosity of the concentrated liquor without any salt.

An optimal salt concentration that achieves the maximum viscosity reduction is reached for each concentration. The viscosities of all three black liquor samples show a decrease with increasing salt concentration with a minimum plateau at salt concentrations between about 0.5 and 0.7M. Further addition of salt causes an increase in viscosity that exceeds (in the case of the 62 percent solids sample) the actual viscosity of the concentrated black liquor without the salt. This increase is due to the effect of the ammonium cation on the pH of the solution.

Although ammonium thiocyanate produces a larger relative effect on the high solids liquor, the viscosity of the more concentrated liquor still remains the largest in magnitude. While the viscosity of each liquor is reduced with ammonium thiocyanate, the viscosity of a liquor with a higher solids content always has a higher viscosity.

FIG. 3 also shows that adding salt to a more concentrated liquor has a larger relative effect on the viscosity. The viscosity of the 73 percent solids black liquor sample decreases by more than three orders of magnitude whereas the viscosity of the 62 percent solids sample is reduced by a factor of about 0.5. With less water present in a strong liquor solution, the salt may have a larger effect because more salt molecules are present per water cluster. In this case, more water structure may be broken, reducing the viscosity more drastically than with a weaker liquor.

EXAMPLE 3

Figure 4:
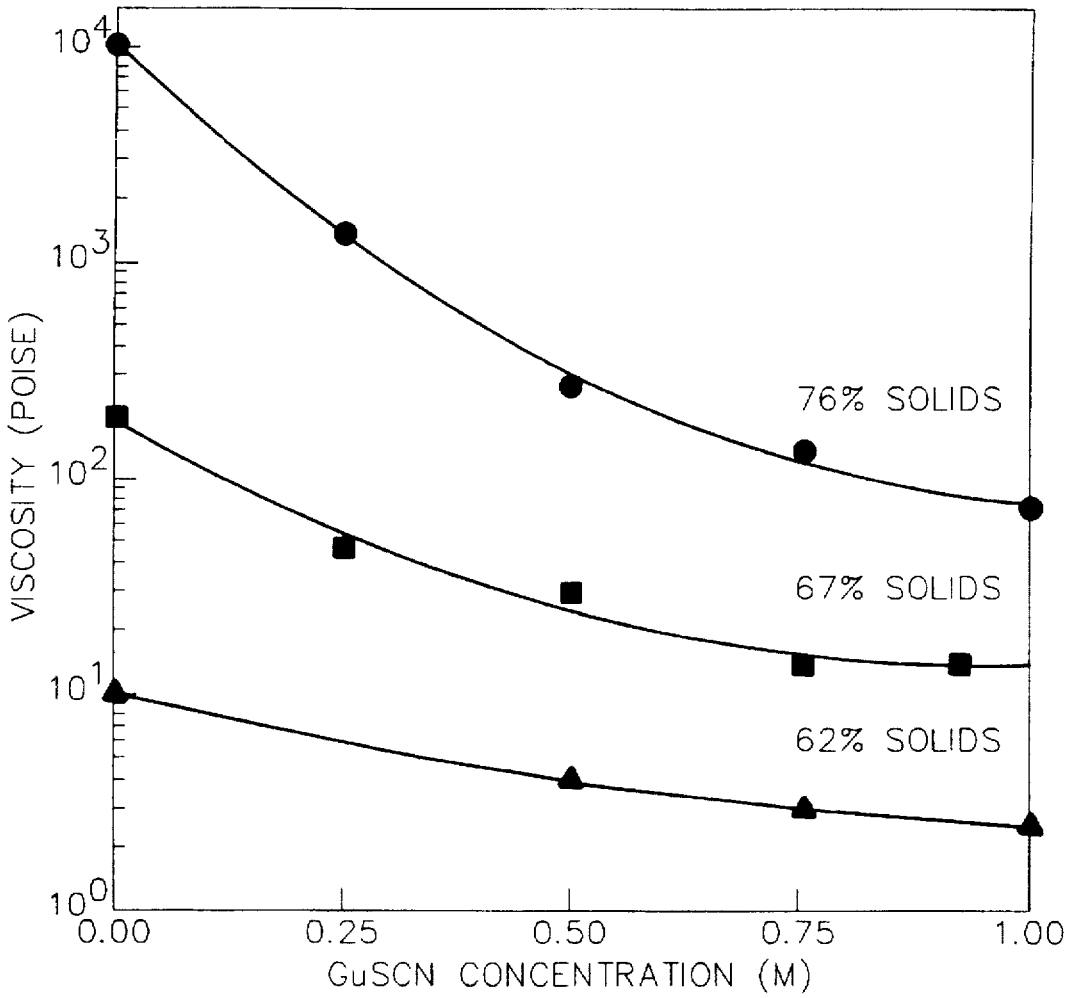
FIG. 4 shows the effect of GuSCN (guanidine thiocyanate) concentration on viscosity of three black liquor samples.

FIG. 4 shows the effect of GuSCN (guanidine thiocyanate) on the viscosity of three black liquor solutions having total solids content of 62 percent, 67 percent, and 76 percent. The concentration of GuSCN from 0.00 to 1.00M is shown along the x-axis, and the viscosity in poise of $10^0$ to $10^4$ is shown on the y-axis.

Unlike the addition of $NH_4SCN$ to black liquor when caused an increase in viscosity at concentrations above about 1M, higher concentrations of GuSCN result in higher reductions in viscosity of black liquor irrespective of solids concentration. Overall, GuSCN yielded substantial reduction in viscosity for the three black liquor solutions. For example as shown in FIG. 4, a black liquor having a solids concentration of 76 percent has a viscosity of $10^4$ (or 10,000) poise which is reduced to $7\times10^1$ (or 70) poise by the addition of 1 mole of GuSCN per kilogram of concentrated black liquor. Similarly, a black liquor having a solids concentration of 67 percent has a viscosity of $1.6\times10^2$ (160) poise which is reduced to about $1.5\times10^1$ (15) poise by the addition of the same amount of GuSCN. FIG. 4 reveals that the addition of GuSCN has the greatest effect on the black liquor containing the highest concentration of solids.

EXAMPLE 4

Figure 5:
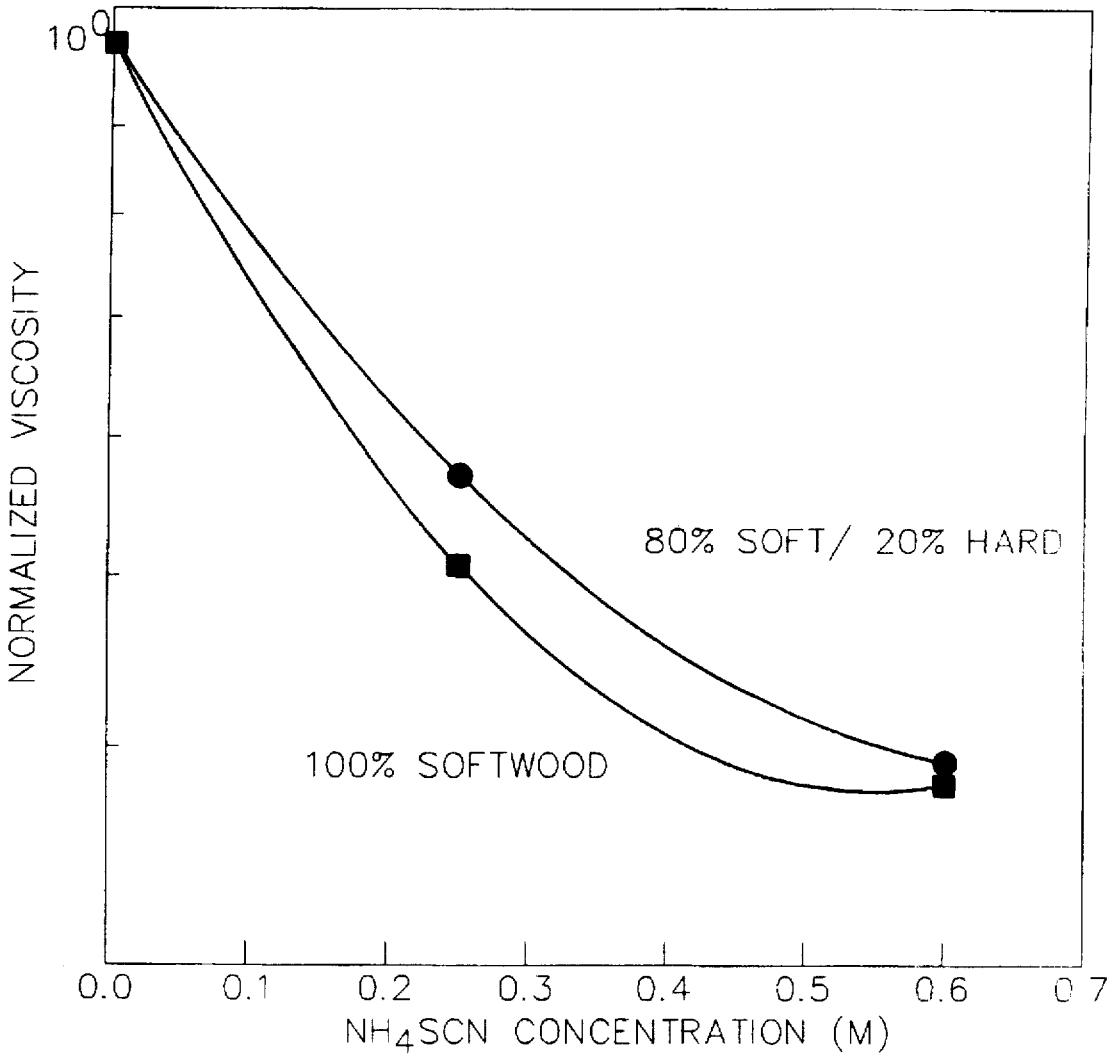

In order to ensure that salting-in is available as a method of viscosity reduction for several types of liquor, a 100 percent softwood was tested and compared to the 80 percent softwood/20 percent hardwood sample. Softwood liquor, like the mixed liquor, is an aqueous system with long polymer chains and surfactants in solution. Salting-in theory should also apply to this liquor. FIG. 5 shows that the two liquor solutions gave very similar results. Ammonium thiocyanate concentration from 0.0 to 0.7M is shown on the x-axis, and normalized viscosity (viscosity of the samples with salt divided by viscosity of the samples without salt) from 0 to 1 is shown on the y-axis. The test results of the 100 percent softwood samples are shown by the solid squares, and the 80 percent softwood/20 percent hardwood samples are shown by the solid circles. The overall compositions of the two liquors differ somewhat, and the solids content of the softwood liquor is slightly lower than the soft/hard mix. These differences in the two liquors may help to account for the small discrepancy in viscosity reduction shown in FIG. 5.

EXAMPLE 5

Black liquor samples were prepared at two temperatures of 60° C. and 25° C. in order to observe the effects of temperature on the viscosity of black liquor containing thiocyanate salts. In this case, the black liquor samples had a solids content of 76 percent prior to the addition of guanidine thiocyanate.

Figure 6:
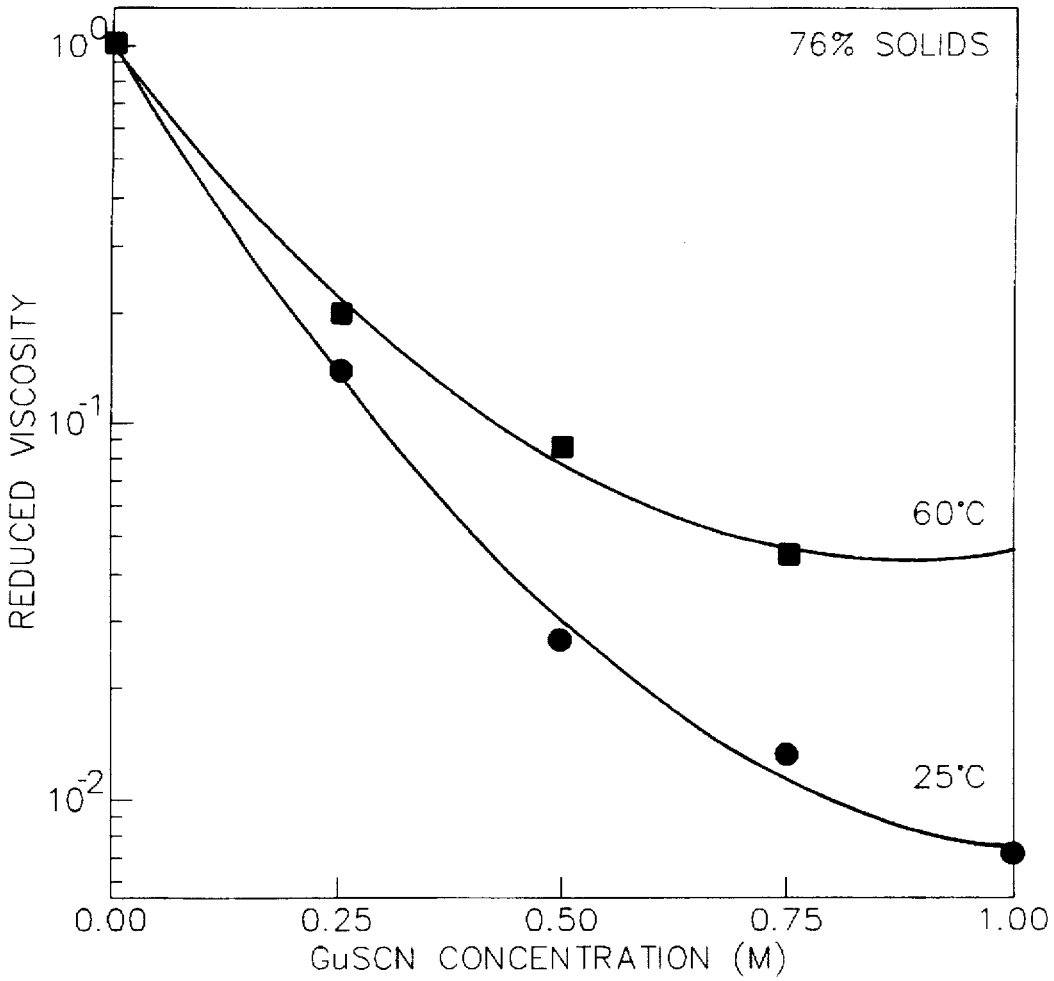
FIG. 6 shows the effect of temperature on viscosity reduction of black liquor using NaSCN (sodium thiocyanate).

FIG. 6 shows that the addition of GuSCN to the black liquor samples at temperatures of 60° C. (line through solid squares) and 25° C. (solid circles) also resulted in a decrease in viscosity of the liquor samples. GuSCN concentration from 0.00 to 1.0M is shown on the x-axis, and the reduced viscosity in poise from $10^{-2}$ to $10^0$ is shown on the y-axis. The reduced viscosity is obtained by dividing the actual viscosity of each black liquor/salt solution by the viscosity of the virgin control black liquor at the same temperature.

EXAMPLE 6

Figure 7:
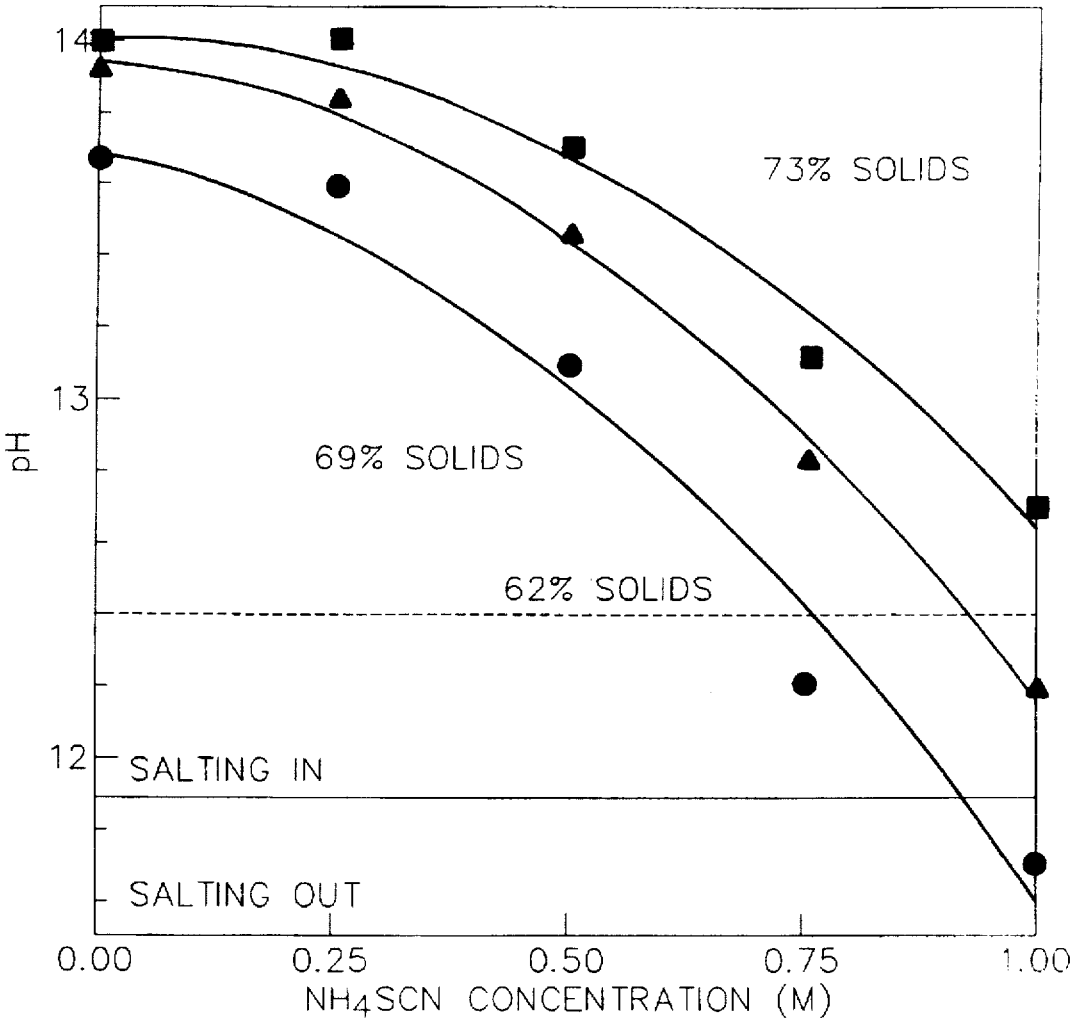
FIG. 7 shows the effect of pH on viscosity reduction of black liquor using $NH_4SCN$.

Tests were also run in order to determine the effect of pH on the reduction of the viscosity of black liquor using a thiocyanate salt. FIG. 7 shows the change in pH v. $NH_4SCN$ concentration for three black liquor samples at different solids concentration, 62 percent (represented by solid circles), 69 percent (solid triangles), and 84 percent (solid squares). $NH_4SCN$ concentration from 0.00 to 1.00M is shown on the x-axis, and pH from 11.5 to 14 is shown on the y-axis. All samples were taken from the Weyerhaeuser 62 percent solids, 80 percent/20 percent mixed black liquor batch. Higher solids samples were evaporated to the appropriate solids content prior to $NH_4SCN$ addition. The dotted line represents the transition between the monotonical decrease in viscosity with increasing $NH_4SCN$ concentration and the start of the increase upon further salt addition. All samples above the solid line reflecting a pH of about 11.9 show salting in behavior, or a reduction in viscosity upon salt addition. Samples below the solid line show the opposite effect, or salting out.

EXAMPLE 7

Figure 8:
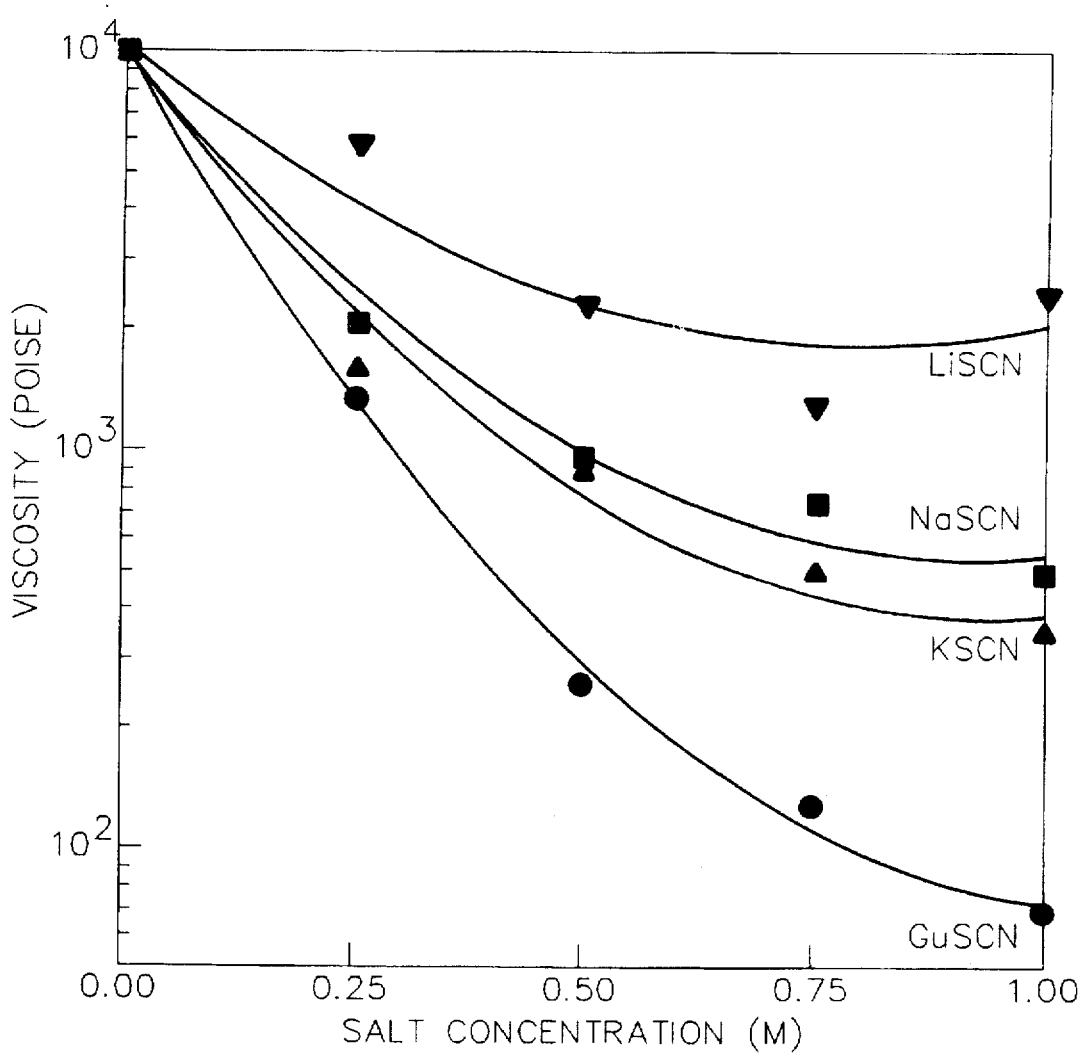
FIG. 8 shows the effect of five cations, which are paired with the thiocyanate anion, on the reduction of viscosity of a black liquor containing 76 percent solids by weight.

FIG. 8 shows the effect of the cation on the ability of the thiocyanate ion to reduce viscosity of black liquor. Salt concentration from 0.00 to 1.00M is shown on the x-axis, and viscosity from $5\times10^1$ to $10^4$ poise is shown on the y-axis. In this test, GuSCN, KSCN, NaSCN, and LiSCN were each added to a black liquor containing 76 percent solids prior to salt addition. This test shows that $Gu^+$ (solid circles) is the preferred cation to pair with the thiocyanate anion in order to maximize viscosity reduction, followed by $K^+$ (solid triangles), $Na^+$ (solid squares), and $Li^+$ (solid upside-down triangles).

The foregoing examples are illustrative of the present invention, and are not to be taken as restrictive thereof. The invention is defined by the following claims, with equivalents of the claims to be included therein.

That which is claimed is:

1. A method of recycling sodium-based salts used for digesting wood in a digester during the manufacture of pulp and paper, said method comprising:

collecting a black liquor from said digester;

concentrating said black liquor; and adding a salt to said black liquor in an amount sufficient to reduce the viscosity thereof, wherein said salt is selected from the group consisting of thiocyanate, perchlorate, iodide, nitrate, and bromide salts;

oxidizing said black liquor to produce a green liquor; then adding a causticizer to said green liquor to produce white liquor containing said sodium-based salts; and then returning said white liquor to said digester.

2. A method according to claim 1, wherein said salt is selected from the group consisting of thiocyanate, perchlorate, and iodide salts.

3. A method according to claim 1, wherein said salt is a thiocyanate salt.

4. A method according to claim 1, wherein said salt is selected from the group consisting of ammonium thiocyanate and guanidine thiocyanate.

5. A method according to claim 1, wherein said amount of salt is between about 0.01 and 5 moles per liter of black liquor.

6. A method according to claim 1, wherein said salt is added to said black liquor in dry form.

* * * * *